US005546174A

United States Patent [19]

Hashizume et al.

[11] Patent Number: 5,546,174

[45] Date of Patent: Aug. 13, 1996

[54] CLEANING MECHANISM OF A FIXING DEVICE IN AN IMAGE FORMING APPARATUS

[75] Inventors: Masahiro Hashizume; Susumu Taniguchi; Shinji Kameyama, all of Osaka, Japan

[73] Assignee: Mita Industrial Co., Ltd., Osaka, Japan

[21] Appl. No.: 329,653

[22] Filed: Oct. 25, 1994

[30] Foreign Application Priority Data

Nov. 8, 1993 [JP] Japan ..... 5-278017

[51] Int. Cl.[6] ..... G03G 15/20

[52] U.S. Cl. ..... 355/283; 355/284

[58] Field of Search ..... 355/283, 284; 118/60, DIG. 1

[56] References Cited

U.S. PATENT DOCUMENTS 4,509,225 4/1985 Haugen ..... 355/283

FOREIGN PATENT DOCUMENTS

| | | | |
|---|---|---|---|
| 57-211179 | 12/1982 | Japan | 355/284 |
| 59-26768 | 2/1984 | Japan | 355/284 |
| 63-85678 | 4/1988 | Japan | 355/283 |
| 63-217389 | 9/1988 | Japan | 355/284 |
| 63-267981 | 11/1988 | Japan | 355/283 |
| 2-247675 | 10/1990 | Japan | 355/283 |

*Primary Examiner*—William J. Royer
*Attorney, Agent, or Firm*—Koda and Androlia

[57] ABSTRACT

A fixing felt is brought into contact with a heating roller surface of an image forming apparatus such that at a predetermined distance towards the downstream side in the direction of rotation of the heating roller from a perpendicular line passing through the center line of the heating roller. As a result, even though foreign matter and residue are accumulated on the contacting part of the fixing felt and the heating roller, such foreign matters and residues will drop and not be transferred to the paper with a latent image.

4 Claims, 3 Drawing Sheets

CLEANING MECHANISM OF A FIXING DEVICE IN AN IMAGE FORMING APPARATUS

BACKGROUND OF THE INVENTION

1. Field of the Invention

The present invention relates to an image forming apparatus in which an electronic photographing system is adopted, and in particular to an image forming apparatus in which improvements are added to a fixing mechanism thereof to fix toner images formed on a sheet of paper via processes of photosensing, development and transfer.

2. Description of the Prior Art

In the image forming apparatus of electronic photographing system, image formation is completed by fixing toner images formed on a sheet of paper such as a transfer paper by the preceding processes. The fixing is carried out by passing a sheet of paper, on which toner images are formed, between a heating roller and a pressure roller to cause toner to be heated and melted.

FIG. 5 shows the outline configuration of a fixing mechanism 15 according to a conventional example of the above image forming apparatus, and the fixing mechanism consists of a heating roller 10 to heat a sheet of paper on which toner images transferred from the preceding process are formed and to cause the toner to be melted, a pressure roller 11 to compress the sheet of paper in cooperation with the heating roller 10, and a fixing felt 12 contacted with pressure to the surface of the heating roller 10, which gives a coat of oil onto the heating roller 10 and cleans it up.

In the conventional fixing mechanism 15, foreign matters and duct on the surface of the heating roller 10 are obliged to be accumulated at the position where the heating roller 10 is brought into contact with the fixing felt 12, and paper dust and toner residues are gradually accumulated upstream in the rotation direction at the position where the fixing felt 12 is brought into contact with the surface of the heating roller 10. There is such a problem that, as such foreign matters and residues are increased, they may easily drop on sheets of paper to cause them to be stained.

SUMMARY OF THE INVENTION

It is therefore an object of the invention to provide an image forming apparatus having a fixing mechanism to which improvements are added so that foreign matters and toner residues, which may be accumulated at the contacting position of the fixing felt and heating roller, do not drop.

In order to achieve the above object, a first invention is, in an image forming apparatus in which a sheet of paper with a latent image on the photosensitive body developed is caused to pass between the heating roller and pressure roller to fix the image, characterized in that a fixing felt which is brought into contact with the surface of the heating roller is arranged in such a state as being spaced with an appointed distance toward the downstream side in the rotation direction of the heating roller from the perpendicular line passing through the centerline of the heating roller.

A second invention is, in an image forming apparatus in which a sheet of paper with a latent image on the photosensitive body developed is caused to pass between the heating roller and pressure roller to fix the image, characterized in that a heat resisting sheet-like material, the top of which is brought into contact with the surface of the heating roller at a contacting angle of less than 90 degrees with an appointed space secured with the fixing felt, is arranged at the upstream side in the rotation direction of the heating roller of a fixing felt contacted to the surface of the heating roller. Furthermore, a third invention is, in an image forming apparatus in which a sheet of paper with a latent image on the photosensitive body developed is caused to pass between the heating roller and pressure roller to fix the image, characterized in that a fixing felt which is intended to come into contact with the surface of the heating roller is brought into contact with the surface of the heating roller in such a state as being pre-pressurized so that the contacting pressure with the heating roller at the upstream side in the rotation direction of the heating roller is made weaker than that at the downstream side thereof.

It is possible to set the clearance between a supporting member to support the fixing felt according to the third invention and the heating roller so that it is made narrower at the downstream side in the rotation direction of the heating roller than at the upstream side and to attach a fixing felt of an appointed initial thickness to the clearance.

It is more preferable that the supporting angle of the supporting member to support the fixing felt according to the third invention is inclined from the radial direction of the heating roller toward the downstream side in the rotation direction of the heating roller.

According to the first invention, a fixing felt is brought into contact with a heating roller at a lower position than the top part in the vertical direction of the heating roller. Therefore, as the position where foreign matters and residues will be accumulated is lower than the top part of the heating roller even though foreign matters and toner residues are accumulated at the contacting portion between the fixing felt and heating roller, they will hardly drop.

According to the second invention, as a heat resisting sheet-like material, the top of which is in contact with the surface of the heating roller, is arranged upstream in the rotation direction at the contacting portion of the fixing felt and heating roller with an appointed clearance secured with the fixing felt, foreign matters and residues will be accumulated between the fixing felt and heat-resisting sheet-like material. As the heat-resisting sheet-like material is in contact with the heating roller surface at a contacting angle of less than 90 degrees, it is difficult for the foreign matters and residues, which will be accumulated, to come out from the heat-resisting sheet-like material. Namely, such foreign matters and residues will hardly drop.

Furthermore, according to the third invention, the fixing felt is pressurized so that the pressure to bring the fixing felt into contact with the heating roller is made weaker at the upstream side in the rotation direction of the heating roller than at the downstream. Therefore, foreign matters and toner residues on the surface of the heating roller are caught by and taken in by the felt at the upstream side where the felt is less pressurized. They will not be accumulated outside the fixing felt. Accordingly, it is possible to prevent foreign matters and residues from dropping.

In a case where the clearance to support a felt of an appointed initial thickness with a supporting member is set to a larger value at the upstream side as such a pre-pressurizing means that the pressure to bring the fixing felt into contact with the heating roller is made smaller at the upstream side than at the downstream, the upstream contacting pressure may be made weaker. And in a case where the fixing felt is inclined and supported toward the downstream side in the rotation direction from the radial line of the heating roller, the upstream contacting pressure may be also made weak.

DETAILED DESCRIPTION OF PREFERRED EMBODIMENTS

Figure 1:
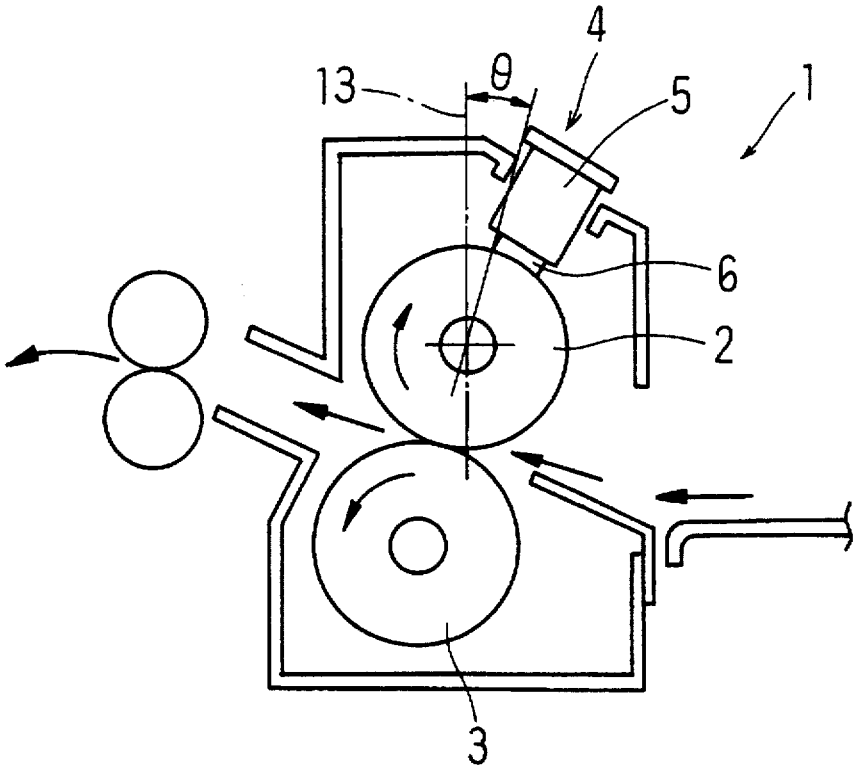
FIG. 1 is a diagram showing a first preferred embodiment of a fixing mechanism which is provided in an image forming apparatus according to the embodiments of the present invention.

An image forming apparatus according to the invention is provided with a fixing mechanism for fixing toner images formed on a sheet of paper via processes of photosensing, development and transferring. As shown in FIG. 1, the fixing mechanism 1 is composed so that toner images are heated, melted and fixed on a sheet of paper by causing a sheet of paper, on which toner images are formed by the preceding processes, to pass between the heating roller 2 and pressure roller 3. A fixing felt 4 is brought into contact with the surface of the heating roller 2 with pressure, thereby causing silicon oil to be coated on the surface of the heating roller 2 and simultaneously the surface thereof to be cleaned up. The fixing felt 4 holds felt 6 saturated with silicon oil by a supporting member 5 and causes the felt 6 to be fitted to the surface of the heating roller 2 with an appointed pressure. In detail, NOMEX (Product name made by Du Pont Corporation) may be used as the felt 6. Foreign matters and residues such as paper chips and toner which are adhered to and brought by the surface of the heating roller are obliged to be accumulated at the position where the fixing felt 4 is brought into contact with the heating roller 2. And as such foreign matters and residues are accumulated, they may easily drop. If dropped foreign matters and residues are caused to stick on sheets of paper, the image may be damaged. A configuration of the preferred embodiment to prevent such foreign matters and residues from being accumulated and dropping will be described below:

With a fixing mechanism 1 shown in FIG. 1 and according to the configuration of the first preferred embodiment, the position where the fixing felt 4 is brought into contact with the heating roller 2 is, as shown in the drawing, set to the position inclined by an angle θ toward the downstream side in the rotation direction of the heating roller 2 from the perpendicular line 13 passing through the centerline of the heating roller 2. Namely, the fixing felt 4 is caused to be brought into contact with the heating roller 2 at a position downward from the top part in the vertical direction of the heating roller 2. Therefore, foreign matters and residues accumulated at the fixing felt 4 will hardly drop because an area of their accumulation is secured at a lower position than the top part of the heating roller 2. Therefore, it is possible to prevent sheets of paper from being stained due to the dropping of foreign matters and residues.

Figure 2:
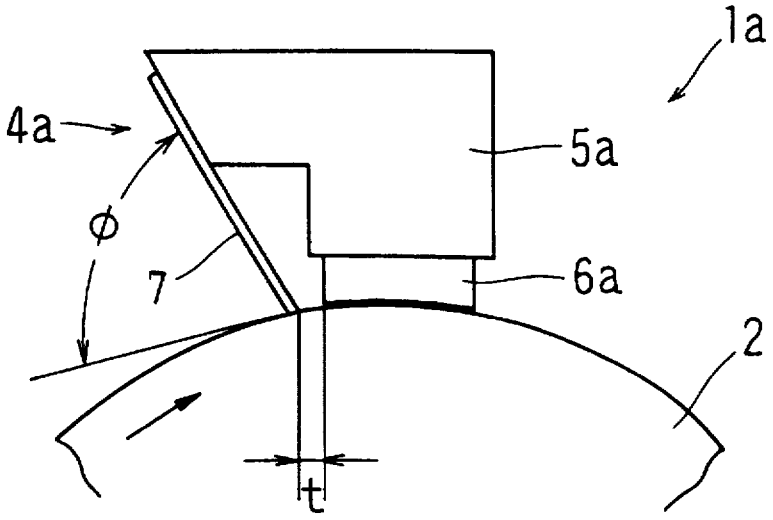
FIG. 2 is a diagram showing a second preferred embodiment of the fixing mechanism.

Next, a fixing mechanism **1*a* according to the second preferred embodiment configuration shown in FIG. 2 is composed of a heat resisting sheet-like material 7 attached to a supporting member 5*a* which constitutes a fixing felt 4*a*. The heat resisting sheet-like material 7 is brought into contact with the surface of the heating roller 2 so that the sheet-like material 7 is located at a more upstream side in the rotation direction of the heating roller 2 than the position where the felt 6*a* is brought into contact with the heating roller 2 and the contacting angle ϕ thereof with the surface of the heating roller 2 is less than 90 degrees. Polyamid imide is preferable as the heat resisting sheet-like material 7. In detail, Kapton (Product manufactured by Du Pont Corporation) may be used. In a case where a clearance t is provided between the part where the heat resisting sheet-like material 7 is in contact with the heating roller 2 and the part where the felt 6*a* is in contact therewith, foreign matters and residues which are adhered to and brought by the surface of the heating roller 2 pass the heat resisting sheet-like material 7 having a weak contacting pressure at an angle θ and are eliminated by the felt 6*a*. As a result, the foreign matters and residues will be accumulated in the clearance t between the heat-resisting sheet-like material 7 and the felt 6, and the felt 6*a***, and as they can not be moved in the reverse direction due to the contacting angle θ, it is possible to prevent the foreign matters and residues from dropping.

Figure 3:
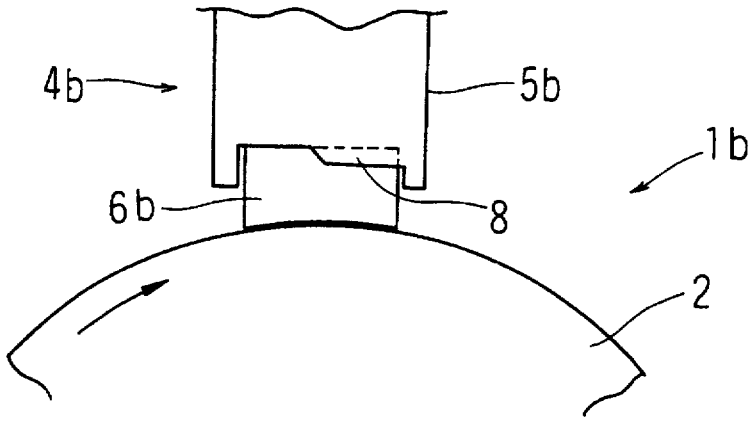
FIG. 3 is a diagram showing a third preferred embodiment of the fixing mechanism.

Next, in a fixing mechanism **1*b* according to the third preferred embodiment configuration shown in FIG. 3, the contacting pressure of the fixing felt 4*b* which is brought into contact with the heating roller 2 with an appointed contacting area is made stronger downstream than upstream in the rotation direction of the heating roller 2. The partial fluctuation of the contacting pressure of the fixing felt 4*b* is, shown in FIG. 3, achieved by installing a projection 8 at one side of the felt holding section of the supporting member 5*b* which holds the felt 6*b* formed to be of an appointed thickness. The position where the projection 8 is to be installed is located downstream in the rotation direction of the heating roller, thereby causing the clearance distance of the felt holding portion of the supporting member 5*b* relative to the heating roller 2 to be made narrower at the downstream side. Therefore, when the felt 6*b* formed to have a constant thickness is compressed toward the heating roller 2 with the felt 6*a* held by the supporting member 5*b*, the compression is such that a weaker contacting pressure will be brought at the upstream side in the rotation direction of the heating roller 2 and a stronger contacting pressure will be brought at the downstream side thereof. As a result, the foreign matters and residues which are adhered to and conveyed by the surface of the heating roller 2 are taken in the felt 6*b*** at the upstream side at which the contacting pressure is weak. The foreign matters and residues accumulated therein are caused not to come out. Therefore, they are prevented from dropping.

Figure 4:
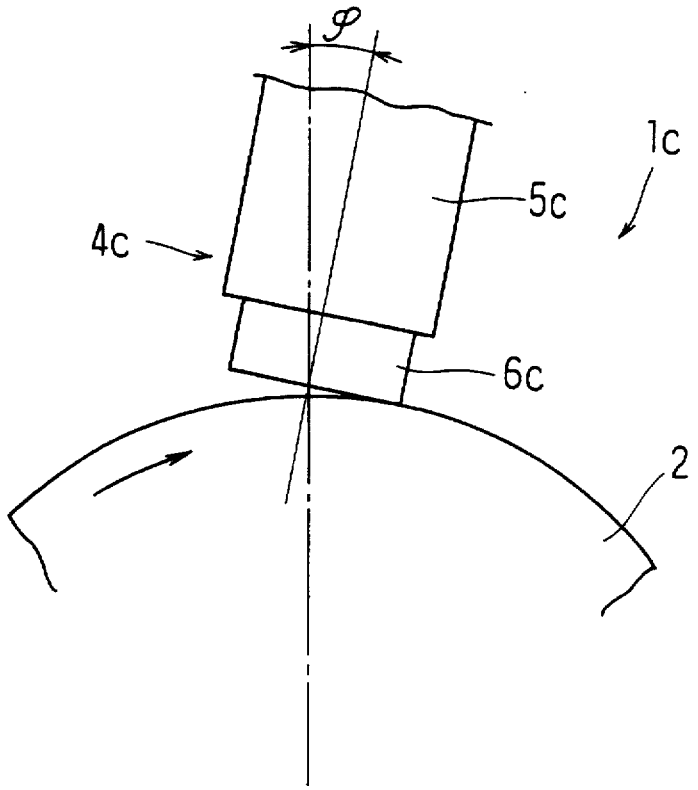
FIG. 4 is a diagram showing a fourth preferred embodiment of the fixing mechanism.
Figure 5:
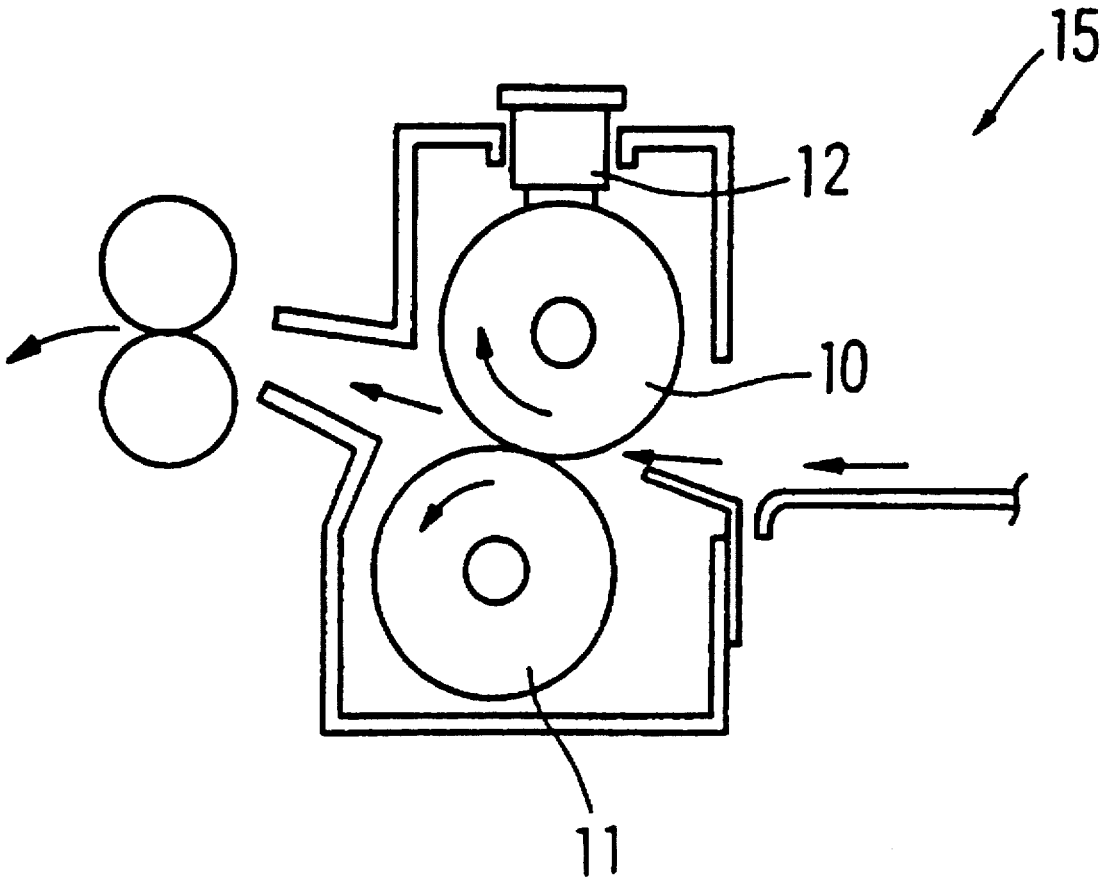
Fig. 5 PRIOR ART
FIG. 5 is a diagram showing the configuration of a fixing mechanism according to a conventional example.

Furthermore, a fixing mechanism **1*c* shown in FIG. 4 and according to the fourth preferred embodiment is composed so that the contacting pressure of the fixing felt 4*c* is made larger at the downstream in the rotation direction of the heating roller 2 than at the upstream thereof by causing the contacting angle of the fixing felt 4*c* relative to the heating roller 2 to be inclined. As shown in FIG. 4, in a case where the contacting angle of the fixing felt 4*c* relative to the heating roller 2 is inclined by an angle of ϕ downstream from the radial direction of the heating roller 2, the contacting pressure of the fixing felt 4*c* relative to the heating roller 2 is made weaker at the upstream side in the rotation direction of the heating roller 2 than at the downstream thereof. As a result, foreign matters and residues which are adhered to and conveyed by the surface of the heating roller 2 are taken in the felt 6*c* held by the supporting members 5*c*** at the upstream side where the contacting pressure is weaker. And such foreign matters and residues will not come out and are prevented from dropping.

According to the present invention described above, the configuration of the fixing felt and heating roller is composed so that foreign matters and residues which may be accumulated in the contacting area therebetween will not drop. Therefore, the fixed images are prevented from being stained.

With the first invention hereof, a fixing felt is brought into contact with a heating roller at the position which is lower than the top part of the heating roller in the vertical direction thereof. Therefore, as the position where foreign matters and residues may be accumulated is lower than the top part of the heating roller even if foreign matters and residues are accumulated in the contacting area between the fixing felt and heating roller, there are almost no cases where foreign matters and residues will drop. And with the second invention, a heat resisting sheet-like material, the top of which is brought into contact with the heating roller surface, is arranged at the upstream side in the rotation direction of the contacting position of the fixing felt and heating roller with an appointed distance secured with the fixing felt. Therefore, foreign matters and residues may be accumulated between the fixing felt and heat-resisting sheet-like material. As the heat resisting sheet-like material is brought into contact with the heating roller surface at a contacting angle of less than 90 degrees, foreign matters and residues accumulated therein will hardly come outside the heat resisting sheet-like material. Namely, they will hardly drop.

Furthermore, with the third invention, the contacting of the fixing felt with the heating roller is pre-pressurized so that the contacting pressure thereof is made weaker at the upstream side in the rotation direction of the heating roller than at the downstream side. Therefore, foreign matters and residues on the surface of the heating roller may be brought in the felt at the upstream side where the fixing felt is less pressurized, and they will not be accumulated outside the fixing felt. Accordingly, such foreign matters and residues are prevented from dropping.

If the clearance to support a felt having an appointed initial thickness with a supporting member is set to a larger value as a means to pre-pressurize so that the pressure to bring the fixing felt into contact with the heating roller is made weaker at the upstream side in the rotation direction of the heating roller than at the downstream side thereof, the upstream contacting pressure may be made weaker.

The upstream contacting pressure may be also reduced by causing the fixing felt to be inclined and supported toward the downstream side in the rotation direction from the radial direction of the heating roller.

What is claimed is:

1. An image forming apparatus in which a sheet of paper with a latent image is caused to pass between a heating roller and pressure roller to fix the image, being characterized in that a heat resisting sheet-like material, a top of which is brought into contact with a surface of the heating roller at a contacting angle of less than 90 degrees with an appointed space secured with a fixing felt, is provided upstream in the rotation direction of the heating roller of said fixing felt.

2. An image forming apparatus in which a sheet of paper with a latent image is caused to pass between a heating roller and pressure roller to fix the image, being characterized in that a fixing felt which is intended to come into contact with a surface of the heating roller is brought into contact with the surface of the heating roller such that a contacting pressure with the heating roller of substantially half of the fixing felt upstream in a rotation direction of the heating roller is made weaker than that of substantially half of the fixing felt downstream thereof.

3. An image forming apparatus defined in claim 2, wherein a clearance between a supporting member to support said fixing felt and said heating roller is set so that it is made narrower at a downstream side of said fixing felt in the rotation direction of the heating roller than at an upstream side of said fixing felt and said fixing felt of an appointed initial thickness is attached to the clearance.

4. An image forming apparatus defined in claim 2, wherein a supporting angle of a supporting member to support said fixing felt is inclined from a radial direction of the heating roller toward a downstream side of said fixing felt in the rotation direction of the heating roller.

* * * * *